US007330107B2

(12) United States Patent
Ito et al.

(10) Patent No.: US 7,330,107 B2
(45) Date of Patent: Feb. 12, 2008

(54) LIGHTING CONTROL CIRCUIT FOR VEHICLE LIGHTING EQUIPMENT

(75) Inventors: Masayasu Ito, Shizuoka (JP); Hitoshi Takeda, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 210 days.

(21) Appl. No.: 11/217,883

(22) Filed: Sep. 1, 2005

(65) Prior Publication Data

US 2006/0055245 A1 Mar. 16, 2006

(30) Foreign Application Priority Data

Sep. 3, 2004 (JP) ..... 2004-256825

(51) Int. Cl.
*B60Q 1/26* (2006.01)

(52) U.S. Cl. ..... 340/468; 340/469; 315/185 R

(58) Field of Classification Search ..... 340/463, 340/464, 467, 468, 469, 475, 478, 479, 815.45; 315/185 R, 224, 308; 362/541, 545
See application file for complete search history.

(56) References Cited

U.S. PATENT DOCUMENTS 5,686,890 A * 11/1997 Ko ..... 340/545.1
6,362,578 B1 * 3/2002 Swanson et al. ..... 315/307
6,371,636 B1 * 4/2002 Wesson ..... 362/545
6,836,081 B2 * 12/2004 Swanson et al. ..... 315/307
7,042,165 B2 * 5/2006 Madhani et al. ..... 315/185 R

FOREIGN PATENT DOCUMENTS

JP 10-86746 4/1998
JP 2004-122986 4/2004
JP 2004-134147 4/2004

OTHER PUBLICATIONS

Patent Abstracts of Japan, Publication No. 10-086746, Publication Date: Apr. 7, 1998, 2 pages.
Patent Abstracts of Japan, Publication No. 2004-122986, Publication Date: Apr. 22, 2004, 1 page.
Patent Abstracts of Japan, Publication No. 2004-134147, Publication Date: Apr. 30, 2004, 1 page.

* cited by examiner

*Primary Examiner*—Van T. Trieu
(74) *Attorney, Agent, or Firm*—Osha Liang LLP

(57) ABSTRACT

A PMOS transistor is inserted in a circuit connecting a power supply terminal of a power supply circuit and a battery terminal. When a control signal input terminal goes to a low level, it is decided that a PWM signal or an H control signal is input into the control signal input terminal. Then, transistors are turned on, and then the PMOS transistor is turned on to apply a battery voltage to the power supply circuit via a power supply terminal, whereby a supply of current to an LED is controlled by the control signal. When the control signal input terminal goes to a high level, it is decided that an L control signal is input as the control signal. Then, the transistors are turned off, and then the PMOS transistor is turned off to cut off a power supply to the power supply circuit from a battery, whereby a dark current can be prevented from flowing through the power supply circuit when the LED is turned off.

5 Claims, 3 Drawing Sheets

LIGHTING CONTROL CIRCUIT FOR VEHICLE LIGHTING EQUIPMENT

BACKGROUND OF THE INVENTION

1. Technical Field

The present invention relates to a lighting control circuit for vehicle lighting equipment and, more particularly, a lighting control circuit for vehicle lighting equipment constructed to control the lightening of a semiconductor light source that is formed of a semiconductor light emitting device.

2. Related Art

In the prior art, as the vehicle lighting equipment, the equipment using a semiconductor light emitting device such as LED (Light Emitting Diode), or the like as a light source is known. Also, the vehicle lighting equipment of this type is equipped with a lightening control circuit that controls the lighting of the LED.

In northern Europe, North America, and others, particularly in the district where an amount of solar radiation is small even in the daytime of winter, the driver is bound to turn on the headlamp of his or her car in the daytime, i.e., DRL (Daytime Running Light). Therefore, in the vehicle such as the car, or the like sold in these countries, the lamp control system that is used to turn on the headlamp in a dimmed lighting mode even in the daytime is employed as (see JP-A-10-86746 (page 2 to page 5, FIG. 1)

In turning on the headlamp of the vehicle as the DRL, there are two ways, i.e., the way of using the dedicated lamp as such headlamp and the way of applying the existing lamp to such headlamp. When the bulb containing a filament that is made of halogen, or the like, for example, is used as the dedicated lamp, such bulb can be turned on in a dimmed lighting mode if the bulb is caused to emit a light at the designated brightness. When the LED is used as the dedicated lamp, such LED can be turned on in a dimmed lighting mode if a predetermined power or current is supplied to the LED.

On the contrary, when the existing lamp is also applied to such headlamp, for example, when the low-beam or high-beam headlamp is also applied to such headlamp, a quantity of light emitted is too much when these lamps are turned on in a full lighting mode. Therefore, from the viewpoint of energy saving, for example, these lamps can be turned on in a dimmed lighting mode using a PWM (Pulse Width Modulation) signal. The PWM signal is such a signal that has a frequency in a range of several hundreds Hz to several tens kHz, for example, and turns on/off a power (voltage/current) request at a certain duty ratio. When a duty ratio of the PWM signal is set to 50%, half of the power required in the full lighting mode is put into the lamp, and thus the brightness emitted from the lamp gives a quantity of light correspondingly. In case the lamp is turned on in a dimmed lighting mode using the PWM signal, either the bulb using the halogen filament or the LED can be employed as the lamp.

In controlling the lighting of the LED, the control signal composed of the PWM signal with a previously set duty ratio is supplied to the semiconductor switching device to turn on/off the semiconductor switching device at the set duty ratio when dimmed lighting conditions are satisfied, so that the LED is turned on to emit a quantity of light that corresponds to the set duty ratio. In this case, sometimes it is requested to employ the binary signal having High/Low values as the control signal when the LED is turned on in a full lighting mode or turned off. Therefore, upon constructing the lighting control circuit for the vehicle lighting equipment to control the lighting of the LED, the lighting of the LED must be controlled by discriminating the control signal. In addition, if the power supply circuit used to control the lighting of the LED or the switching regulator is directly connected to the battery power supply, a minute dark current flows through the power supply circuit or the switching regulator depending on the circuit configuration of the power supply circuit or the switching regulator the moment the LED is turned off. As a result, there is a possibility that the battery voltage is wasted.

SUMMARY OF THE INVENTION

One or more embodiments of the present invention control a lighting of a semiconductor light source based on a control signal the moment the semiconductor light source is turned on, and also to prevent a flow of a dark current the moment the semiconductor light source is turned off.

In accordance with one or more embodiments, a lighting control circuit for vehicle lighting equipment comprises current supplying means for controlling a supply of current to a semiconductor light source based on a control signal, while using an input voltage from a power supply as a luminous energy of the semiconductor light source; switching means for opening/closing a circuit connecting the power supply and the current supplying means, in response to a command; a controlling means for controlling opening/closing actions of the switching means by discriminating the control signal; wherein the controlling means commands the switching means to take a closing action when the control signal corresponds to a signal that commands the semiconductor light source to turn on in a full lighting mode or a dimmed lighting mode, and commands the switching means to take an opening action when the control signal corresponds to a signal that commands the semiconductor light source to turn off.

(Effect) Upon controlling the supply of the current to the semiconductor light source by the current supplying means, the control signal is discriminated and then the supply of current to the semiconductor light source is controlled in accordance with the discriminated result. Then, when the control signal corresponds to the signal that commands the semiconductor light source to turn on in a full lighting mode or a dimmed lighting mode, the controlling means causes the switching means to take the closing action and to close the circuit connecting the power supply and the current supplying means, and then the current is supplied to the semiconductor light source from the power supply via the current supplying means. In contrast, when the control signal corresponds to the signal that commands the semiconductor light source to turn off, the controlling means causes the switching means to take the opening action and to open the circuit connecting the power supply and the current supplying means. Therefore, the lighting of the semiconductor light source can be controlled in accordance with the control signal when the semiconductor light source is to be turned on, and also the power supply to the current supplying means can be cut off when the semiconductor light source is to be turned off. As a result, it can be prevented that a dark current flows through the current supplying means from the power supply, and also it can be prevented that the power supply is wasted.

In accordance with one or more embodiments, the lighting control circuit for the vehicle lighting equipment further comprises auxiliary controlling means for controlling a drive of the current supplying means in compliance with a discriminated result of the controlling means; wherein the auxiliary controlling means drives the current supplying means when the discriminated result indicating that the control signal corresponds to the signal that commands the semiconductor light source to turn on in the full lighting mode or the dimmed lighting mode is output from the controlling means, and stops the drive of the current supplying means when the discriminated result indicating that the control signal corresponds to the signal that commands the semiconductor light source to turn off is output from the controlling means.

(Effect) The current supplying means is driven when the discriminated result indicating that the control signal corresponds to the signal that commands the semiconductor light source to turn on in the full lighting mode or the dimmed lighting mode is derived, while the drive of the current supplying means is stopped when the discriminated result indicating that the control signal corresponds to the signal that commands the semiconductor light source to turn off is derived. Therefore, when the semiconductor light source is to be turned off, the power supply to the current supplying means is cut off and also the drive of the current supplying means is stopped. As a result, it can be prevented more surely that the dark current flows through the current supplying means.

In accordance with one or more embodiments, the lighting control circuit for the vehicle lighting equipment further comprises control signal correcting means for correcting a duty ratio of a PWM signal in response to characteristics of the semiconductor light source and then outputting a corrected control signal to the current supplying means when the control signal corresponds to the PWM signal that commands the semiconductor light source to turn on in the dimmed lighting mode.

(Effect) When the control signal corresponds to the PWM signal that commands the semiconductor light source to turn on in the dimmed lighting mode, the duty ratio of the PWM signal is corrected in response to the characteristics of the semiconductor light source. Therefore, if the signal prepared to turn on the light source such as the halogen lamp, or the like, for example, in the dimmed lighting mode is used to turn on the LED in the dimmed lighting mode, the LED can be turned on in the dimmed lighting mode to emit a predetermined quantity of light. For example, when the halogen lamp is turned on in the dimmed lighting mode by the PWM signal with the duty ratio of 25%, the 25% current is supplied to the halogen lamp and a quantity of emitted light becomes about 10% of the quantity of emitted light in the full lighting mode. In contrast, since a quantity of emitted light becomes too large when the PWM signal with the duty ratio of 25% is applied as it is to the LED, the 10% control current is supplied to the LED by correcting the PWM signal. As a result, even when the PWM signal prepared for the halogen lamp is employed, the LED can be turned on in the dimmed lighting mode to emit a predetermined quantity of light.

As apparent from the above explanation, embodiments of the present invention may include one or more of the following advantages. According to one or more embodiments, this lighting control circuit for the vehicle lighting equipment can prevent dark current from flowing through the current supplying means from the power supply, and can prevent that the power supply from being wasted.

According to one or more embodiments, auxiliary control means can be used to prevent more surely dark current from flowing through the current supplying means.

According to one or more embodiments, even though the PWM signal prepared for the light source different from the LED is used, the LED can be turned on in the dimmed lighting mode to emit a predetermined quantity of light.

DETAILED DESCRIPTION OF THE INVENTION

Figure 1:
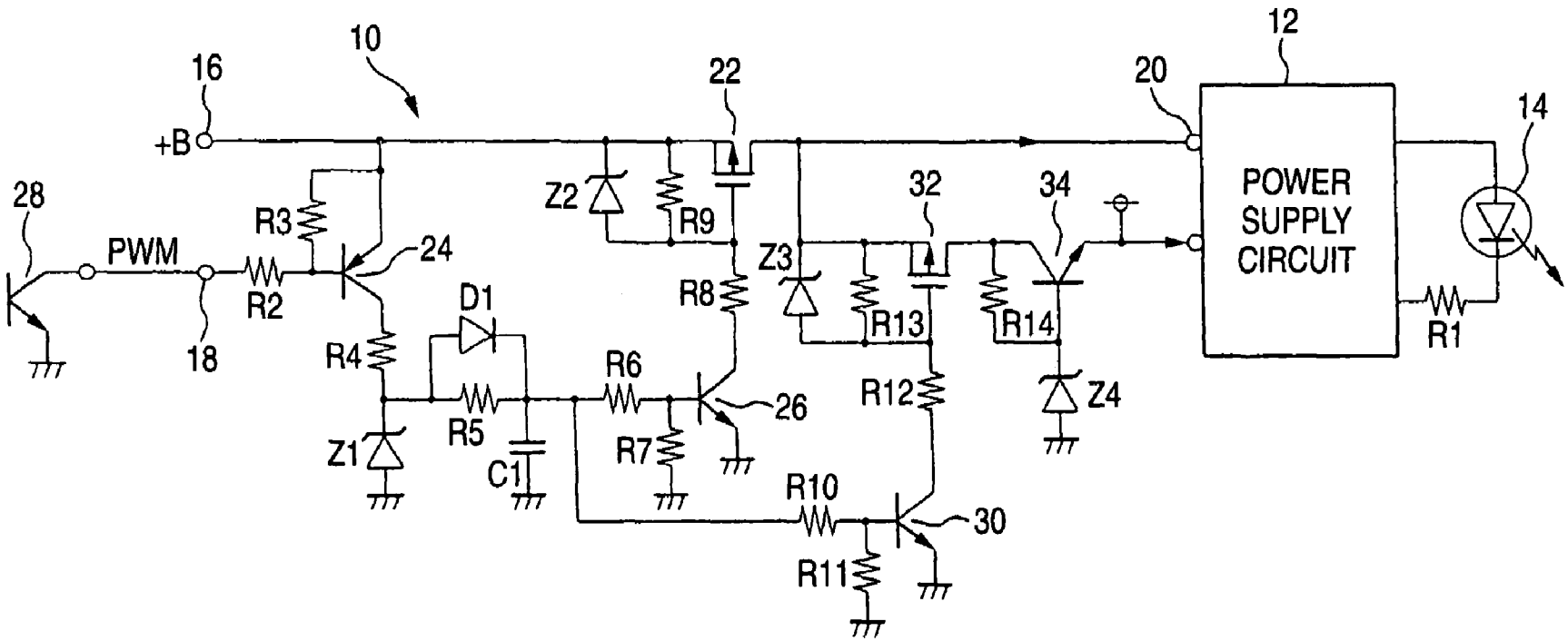
[FIG. 1] A circuit diagram of a lighting control circuit for vehicle lighting equipment showing an embodiment of the present invention.
Figure 2:
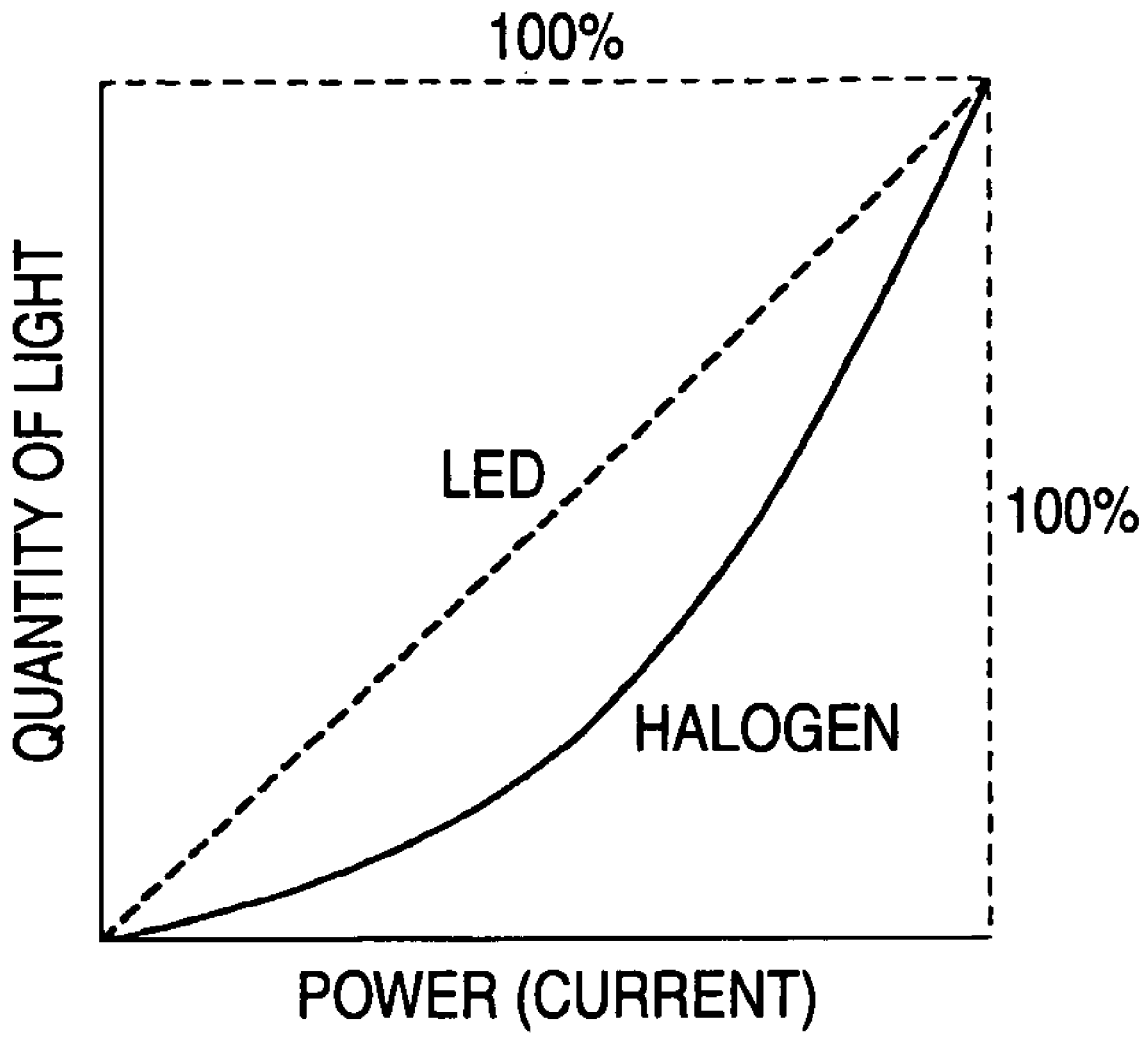
[FIG. 2] A characteristic view showing a relationship between a power (current) and a quantity of light in regarding to a halogen lamp and an LED.
Figure 3:
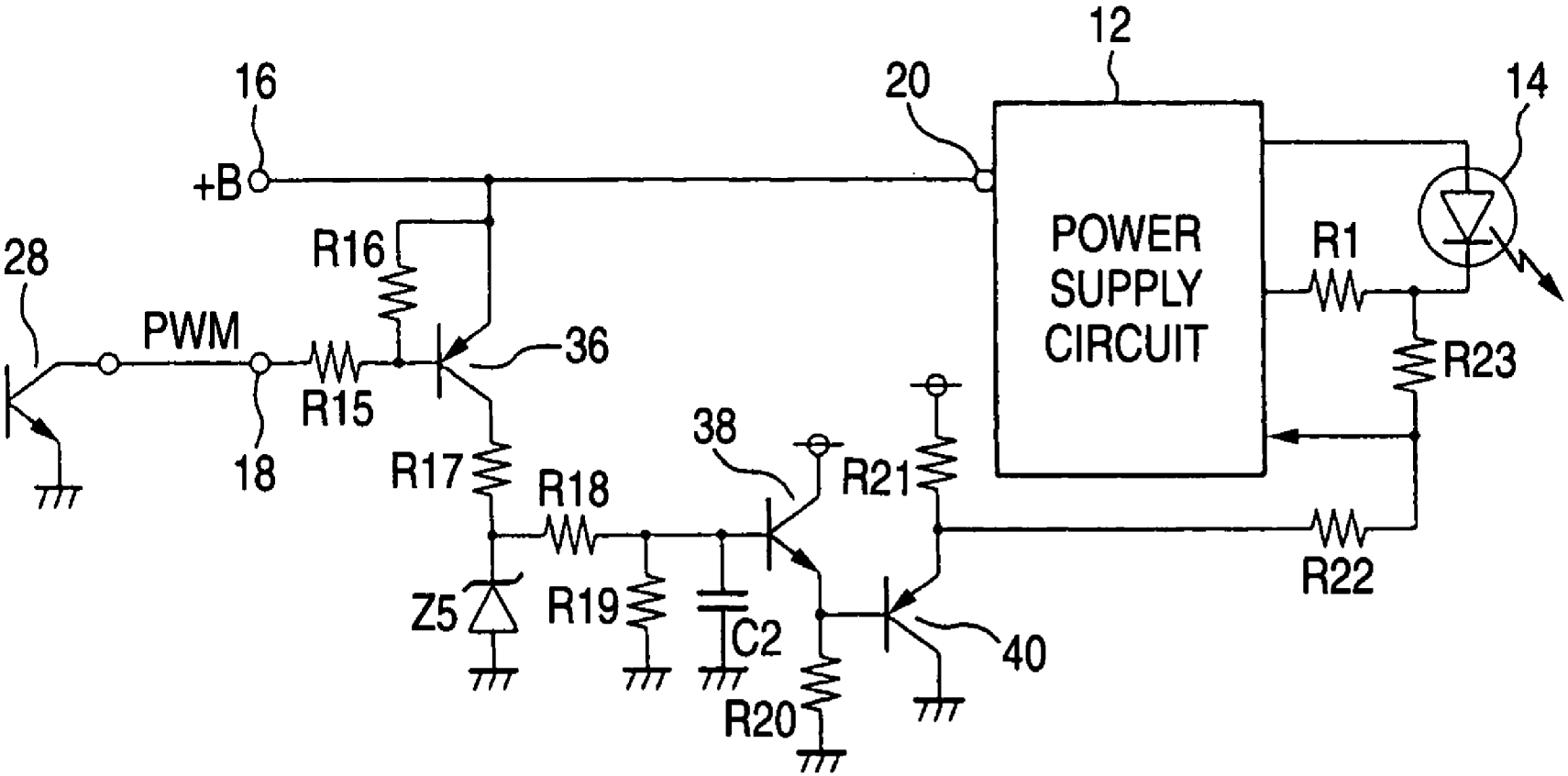
[FIG. 3] A circuit diagram of a lighting control circuit for vehicle lighting equipment showing another embodiment of the present invention.

Next, embodiments of the present invention will be explained with reference to examples. FIG. 1 is a circuit diagram of a lighting control circuit for vehicle lighting equipment showing an embodiment of the present invention. FIG. 2 is a characteristic view showing a relationship between a power (current) and a quantity of light in regarding to a halogen lamp and an LED. FIG. 3 is a circuit diagram of a lighting control circuit for vehicle lighting equipment showing another embodiment of the present invention.

In these Figures, a lighting control circuit 10 for vehicle lighting equipment has a power supply circuit 12, as one element of the vehicle lighting equipment. The power supply circuit 12 is constructed by the switching regulator, for example, and is connected to an LED 14 as a semiconductor light source consisting of a semiconductor light emitting device via a shunt resistor R1. This LED 14 is constructed as the light source for the high-beam lamp that is also used as the DRL. In this case, the LED 14 can also be used as other light sources such as the low-beam lamp, the clearance lamp, and the like.

The power supply circuit 12 is constructed as current supplying means that controls a supply of current to the LED 14 based on the control signal input into the control signal input terminal 18, while using an input voltage input into a battery terminal 16 connected to an onboard battery as a luminous energy of the LED 14. For example, the power supply circuit 12 is constructed to execute such a control that the current flowing through the LED 14 is converted by the shunt resistor R1 and then the voltage developed across the shunt resistor R1 is kept at a constant voltage, i.e., the current flowing through the LED 14 is kept constant, using the converted voltage as the feed-back voltage. A PMOS transistor 22 acting as a switching means to open/close a circuit that connects a power supply terminal 20 of the power supply circuit 12 and the battery terminal 16 is inserted into the circuit. The PMOS transistor 22 opens/closes the circuit that connects the battery terminal 16 and the power supply terminal 20, in accordance with the discriminated result of controlling means that discriminates the control signal. Specifically, this PMOS transistor 22 is turned on to close the circuit connecting the battery terminal 16 and the power supply terminal 20 and supply the power to the power supply circuit 12 when such transistor is commanded by the controlling means to take a closing action (ON action), and also is turned off to open the circuit connecting the battery terminal 16 and the power supply terminal 20 and cut off the power supply from the battery terminal 16 to the power supply terminal 20 when such transistor is commanded to take an opening action (OFF action).

The controlling means for controlling the ON/OFF operations of the PMOS transistor 22 is constructed to have resistors R2, R3, R4, R5, R6, R7, R8, R9, a PNP transistor 24, an NPN transistor 26, Zener diodes Z1, Z2, a diode D1, and a capacitor C1. One end side of the resistor R2 is connected to a control signal input terminal 18. The control signal input terminal 18 is connected to a collector of an NPN transistor 28 provided on the vehicle side. This NPN transistor 28 on the vehicle side is turned on/off in response to the control signal output from a control unit that controls the lamps, and the like of the vehicle, for example. The binary signal having H (high)/L (low) levels is used as the control signal, for example. The NPN transistor 28 is turned on when the H control signal corresponds to the signal that commands the LED 14 to turn on in a full lighting mode, while the NPN transistor 28 is turned off when the L control signal corresponds to the signal that commands the LED 14 to turn off. Also, the PWM signal is used as the control signal. The NPN transistor 28 is turned on when this PWM signal corresponds to the signal that commands the LED 14 to turn on in a dimmed lighting mode. In more detail, when the NPN transistor 28 is turned on, a level of the control signal input terminal 18 goes to a low level to discriminate that the H signal or the PWM signal is input into the control signal input terminal 18 as the control signal, then the PNP transistor 24 is turned on, and then the voltage is applied across the Zener diode Z1. This voltage applied across the Zener diode Z1 charges the capacitor C1 via the resistor R5. When the voltage developed across the capacitor C1 exceeds a set level, the NPN transistor 26 is turned on to command PMOS transistor 22 to take the ON action (closing action). In this case, when the PWM signal is input as the control signal, a charging/discharging circuit consisting of the resistor R5 and the capacitor C1 repeats charging/discharging operations in compliance with the duty ratio of the PWM signal. At this time, if respective constants of the charging/discharging circuit are set such that a charging rate of the capacitor C1 is increased but a discharging rate of the capacitor C1 is decreased, the NPN transistor 26 and the PMOS transistor 22 can always be maintained in their ON state during one period of the PWM signal after the level of the PWM signal goes to the low level (0 V). As a result, the LED 14 is turned on in a full lighting mode to function as the high-beam lamp of the headlamp when the H signal is input whereas the LED 14 is turned on in a dimmed lighting mode to function as the DRL when the PWM signal is input.

In contrast, when the NPN transistor 28 provided on the vehicle side is turned off, a level of the control signal input terminal 18 is shifted to a high impedance state, then the PNP transistor 24 is turned off to discriminate that the L signal is input into the control signal input terminal 18 as the control signal, then the NPN transistor 26 is turned off following to the discharge of the electric charges accumulated in the capacitor C1 to command the PMOS transistor 22 to take the OFF action (opening action). As a result, the power supplied to the power supply circuit 12 is cut off.

Also, in the present embodiment, auxiliary controlling means for controlling the drive of the power supply circuit 12 in accordance with the discriminated result of the controlling means is provided. This auxiliary controlling means is constructed to include a resistor R10, a resistor R11, a resistor R12, a resistor R13, a resistor R14, Zener diodes Z3, Z4, a NPN transistor 30, a PMOS transistor 32, and an NPN transistor 34. One end side of the resistor R10 is connected to one end side of the capacitor C1. A source electrode of the PMOS transistor 32 is connected to the power supply terminal 20. An emitter of the NPN transistor 34 is connected to a control power supply (not shown) of the power supply circuit 12. In this case, the resistor R14, the Zener diode Z4, and the NPN transistor 34 are constructed as a stabilized power supply.

This auxiliary controlling means is constructed such that, when the PNP transistor 24 is turned on by the PWM signal or the H control signal being input into the NPN transistor 28 and then the voltage developed across the capacitor C1 exceeds a set level, the NPN transistor 30 is turned on and also both the PMOS transistor 32 and the NPN transistor 34 are turned on. When respective transistors 30, 32, 34 are turned on, the voltage input into the battery terminal 16 is supplied to the control power supply of the power supply circuit 12 via the transistors 22, 32, 34 and then the power supply circuit 12 is driven.

In contrast, when the L signal is input into the NPN transistor 28 as the control signal and the PNP transistor 24 is turned off, the NPN transistor 30 is turned off and also both the PMOS transistor 32 and the NPN transistor 34 are turned off. Thus, the supply of the power to the control power supply is stopped and then the drive of the power supply circuit 12 is stopped.

In this manner, in the present embodiment, only when the PWM signal or the H signal out of the H/L binary signals is input into the NPN transistor 28 as the control signal, the voltage input into the battery terminal 16 is supplied to the power supply circuit 12 via the PMOS transistor 22 and also the power is supplied to the control power supply via the PMOS transistor 32 and the NPN transistor 34, so that the lighting of the LED 14 can be controlled by the control signal. In contrast, when the L signal is input into the NPN transistor 28 as the control signal, the PMOS transistor 22 is turned off to cut off the power supply to the power supply circuit 12 and also the power supply to the control power supply is cut off. Therefore, it can be prevented more surely that a dark current flows through the power supply circuit the moment the LED 14 is turned off, and also it can be prevented that the battery power supply is wasted.

In the present embodiment, when the control signal corresponds to the L signal out of the H/L binary signals, no current is fed to all the transistors 22, 24, 26, 30, 32, and 34. Therefore, generation of the dark current can be prevented more surely.

Also, in the present embodiment, the approach of cutting off the power supply to the control power supply when the L signal is used as the control signal is described. But generation of the dark current can be prevented without the auxiliary controlling means by turning off the PMOS transistor 22 only.

Here, in the case where the PWM signal is used as the signal to turn on the halogen lamp, for example, in a dimmed lighting mode, when the power generated based on the PWM signal is applied to the halogen lamp, a relationship between a power (current) and a quantity of emitted light at this time is given as the characteristic shown in FIG. 2. For example, when the PWM signal with a duty ratio of 25% is applied to the halogen lamp, the power (current) supplied to the halogen lamp becomes 25% and a quantity of emitted light becomes about 10% of the quantity of emitted light in a full lighting mode. On the contrary, if the LED is turned on by the PWM signal for the halogen lamp, a quantity of light that is larger than that of the halogen lamp is emitted from the LED by the same power (current). Hence, the PWM signal used to drive the halogen lamp cannot be applied as it is to the lighting control circuit for the vehicle lighting equipment used to drive the LED.

Therefore, in the present embodiment, upon employing the LED, whose relationship between the power (current) and the quantity of light shows an substantially linear characteristic, instead of the halogen lamp, a control signal correcting circuit for correcting the duty ratio of the PWM signal (control signal) generated for the halogen lamp to meet the characteristic of the LED, i.e., correcting a light dimming rate and then outputting the corrected control signal to the power supply circuit 12 is provided.

As shown in FIG. 3, this control signal correcting circuit acting as control signal correcting means is constructed to have resistors R15, R16, R17, R18, R19, R20, R21, R22, R23, a Zener diode Z5, a capacitor C2, a PNP transistor 36, an NPN transistor 38, and a PNP transistor 40. One end side of the resistor R15 is connected to the control signal input terminal 18, and one end side of the resistor R23 is connected to a connection point between the shunt resistor R1 and the LED 14.

When the NPN transistor 28 on the vehicle side is turned on and the control signal input terminal 18 goes to the low level, the PNP transistor 36 discriminates that the PWM signal is input as the control signal and turns on to apply the voltage across the Zener diode Z5. The voltage developed across the Zener diode Z5 is applied across the capacitor C2 via the resistor R18, and the electric charges are accumulated in the capacitor C2. At this time, the capacitor C2 repeats the charging/discharging operations in response to the duty ratio of the PWM signal, and then an average voltage of the PWM signal is generated from the capacitor C2. When the voltage across the capacitor C2 exceeds a set level, the NPN transistor 38 is turned on and also the PNP transistor 40 is turned on. Thus, a current decided by an emitter potential of the PNP transistor 40 and a resistance value of the resistor R22 is supplied to the power supply circuit 12 via the shunt resistor R1. This current is set to take account of the characteristic of the LED 14.

For example, in the case where the signal used to turn on the halogen lamp in a dimmed lighting mode at a duty ratio of 25% is employed as the PWM signal, when the halogen lamp is driven by this PWM signal, the control current of 25% is supplied to the halogen lamp and also a quantity of emitted light becomes about 10% of the quantity of emitted light in a full lighting mode (see FIG. 2). In contrast, when the PWM signal having a duty ratio of 25% is applied to the LED 14 as it is, a quantity of emitted light becomes too much, as can be appreciated from the characteristic shown in FIG. 2. Therefore, the PWM signal is corrected by the emitted potential and the resistance value of the resistor R22 to supply the 10% control current to the LED 14. Accordingly, like the case of the halogen lamp, a quantity of emitted light of the LED 14 can be restricted to 10% of the quantity of emitted light in a full lighting mode using the PWM signal having the duty ratio of 25%, and thus the PWM signal can be used commonly in both the lighting control circuit for driving the halogen lamp and the lighting control circuit for driving the LED 14. That is, the light dimming rate of the LED 14 can be set to conform to the light dimming rate of the halogen lamp.

In the case where such a control is repeated so that the power supply circuit 20 is caused to drive/stop in accordance with the PWM signal input into the power supply terminal 20, when the control current that is set to 40% of the current in a full lighting mode (100%) is supplied to the LED 14 in response to the PWM signal with the duty ratio of 25%, a quantity of emitted light of the LED 14 can be set to $0.4 \times 0.25 = 0.1$ (10%) using the PWM signal with the duty ratio of 25%.

In the present embodiment, the approach of correcting the light dimming rate in response to the duty ratio of the PWM signal is described. If the controlling means and the auxiliary controlling means shown in FIG. 1 are provided between the power supply terminal 20 of the power supply circuit 12 and the battery terminal 16, the dark current can be prevented from flowing through the power supply circuit 12.

We claim:

1. A lighting control circuit for vehicle lighting equipment, comprising:

current supplying means for controlling a supply of current to a semiconductor light source based on a control signal, while using an input voltage from a power supply as a luminous energy of the semiconductor light source;

switching means for opening/closing a circuit connecting the power supply and the current supplying means, in response to a command; and controlling means for controlling opening/closing actions of the switching means by discriminating the control signal; wherein the controlling means commands the switching means to take a closing action when the control signal corresponds to a signal that commands the semiconductor light source to turn on in a full lighting mode or a dimmed lighting mode, and commands the switching means to take an opening action when the control signal corresponds to a signal that commands the semiconductor light source to turn off.

2. The lighting control circuit for vehicle lighting equipment according to claim 1, further comprising:

auxiliary controlling means for controlling a drive of the current supplying means in compliance with a discriminated result of the controlling means; wherein the auxiliary controlling means drives the current supplying means when the discriminated result indicating that the control signal corresponds to the signal that commands the semiconductor light source to turn on in the full lighting mode or the dimmed lighting mode is output from the controlling means, and stops the drive of the current supplying means when the discriminated result indicating that the control signal corresponds to the signal that commands the semiconductor light source to turn off is output from the controlling means.

3. The lighting control circuit for vehicle lighting equipment according to claim 2, further comprising:

a control signal correcting means for correcting a duty ratio of a PWM signal in response to characteristics of the semiconductor light source and then outputting a corrected control signal to the current supplying means when the control signal corresponds to the PWM signal that commands the semiconductor light source to turn on in the dimmed lighting mode.

4. The lighting control circuit for vehicle lighting equipment according to claim 1, further comprising:

control signal correcting means for correcting a duty ratio of a PWM signal in response to characteristics of the semiconductor light source and then outputting a corrected control signal to the current supplying means when the control signal corresponds to the PWM signal that commands the semiconductor light source to turn on in the dimmed lighting mode.

5. The lighting control circuit for vehicle lighting equipment according to claim 1, wherein the input voltage from the power supply is directly inputted into the current supplying means.

* * * * *